US006790316B1

(12) United States Patent
Hasanen et al.

(10) Patent No.: US 6,790,316 B1
(45) Date of Patent: Sep. 14, 2004

(54) METHOD AND ARRANGEMENT FOR POSITIONING A SHOE OF A SHOE PRESS/ SHOE CALENDAR IN A PAPER MACHINE

(75) Inventors: Kari Hasanen, Kerava (FI); Timo Torvi, Järvenpää (FI); Helena Leppäskoski, Jërvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/980,061

(22) PCT Filed: May 31, 2000

(86) PCT No.: PCT/IB00/00732

§ 371 (c)(1),
(2), (4) Date: Mar. 5, 2002

(87) PCT Pub. No.: WO00/79042

PCT Pub. Date: Dec. 28, 2000

(51) Int. Cl.[7] ..... D21F 3/02

(52) U.S. Cl. ..... 162/358.3; 162/199; 162/205; 162/252; 162/272; 162/361; 100/43; 100/99; 100/154

(58) Field of Search ..... 162/358.3, 272, 162/199, 361, 205, 252, 253, 358.1; 100/153, 154, 43, 46, 99; 492/10, 11, 7

(56) References Cited

U.S. PATENT DOCUMENTS

| | | | | | |
|---|---|---|---|---|---|
| 3,670,644 | A | * | 6/1972 | Hoever et al. | 100/168 |
| 4,472,958 | A | * | 9/1984 | Biondetti | 72/241.6 |
| 4,509,237 | A | * | 4/1985 | Volz et al. | 29/7 |
| 5,209,091 | A | * | 5/1993 | Koenigbauer et al. | 100/48 |
| 5,389,205 | A | | 2/1995 | Pajula et al. | |
| 5,496,442 | A | * | 3/1996 | Laapotti | 162/358.3 |
| 5,507,916 | A | * | 4/1996 | Schiel | 162/358.3 |
| 5,611,893 | A | | 3/1997 | Pajula et al. | |
| 5,711,854 | A | * | 1/1998 | Schiel et al. | 162/358.3 |
| 5,753,084 | A | * | 5/1998 | Bubik et al. | 162/358.3 |
| 5,897,476 | A | * | 4/1999 | Ehrola et al. | 167/358.3 |
| 5,997,696 | A | * | 12/1999 | Gustavsson et al. | 162/358.3 |
| 6,012,386 | A | | 1/2000 | Lahtinen et al. | |
| 6,205,369 | B1 | * | 3/2001 | Moore | 167/358.3 |
| 6,430,459 | B1 | * | 8/2002 | Moore | 700/122 |

FOREIGN PATENT DOCUMENTS

| | | |
|---|---|---|
| CA | 2127767 | 1/1995 |
| EP | 0 823 507 A3 | 2/1998 |
| FI | 943278 | 1/1995 |
| FI | 96789 | 5/1996 |
| WO | 98/36185 | 8/1998 |
| WO | 00/79042 | 12/2000 |

OTHER PUBLICATIONS

Search Report issued in Finnish Priority Application No. 991272.

* cited by examiner

*Primary Examiner*—Steven P. Griffin
*Assistant Examiner*—Eric Hug
(74) *Attorney, Agent, or Firm*—Stiennon & Stiennon

(57) ABSTRACT

The invention relates to a method for positioning a shoe of a shoe press/shoe clender in a paper machine. In the method, the position of the shoe (11) of the shoe calender/shoe press is measured and, based on the results of the measurement, the position of the shoe is controlled so as to be as desired in the direction of nip compression. The invention also relates to an arrangment for positioning a shoe of a shoe press/shoe calender in a paper machine, which arrangment comprises a shoe roll (10) or equivalent which includes a shoe (11) and hydraulic cylinders (12) connected thereto for moving the shoe (11). The arrangement comprises further at least two measuring devices (15) for measuring the position of the shoe (11) and means (12) for controlling the position of the shoe (11) based the results obtained by means of the measuring devices so as to be as desired in the direction of nip compression.

15 Claims, 2 Drawing Sheets

Figure 1:
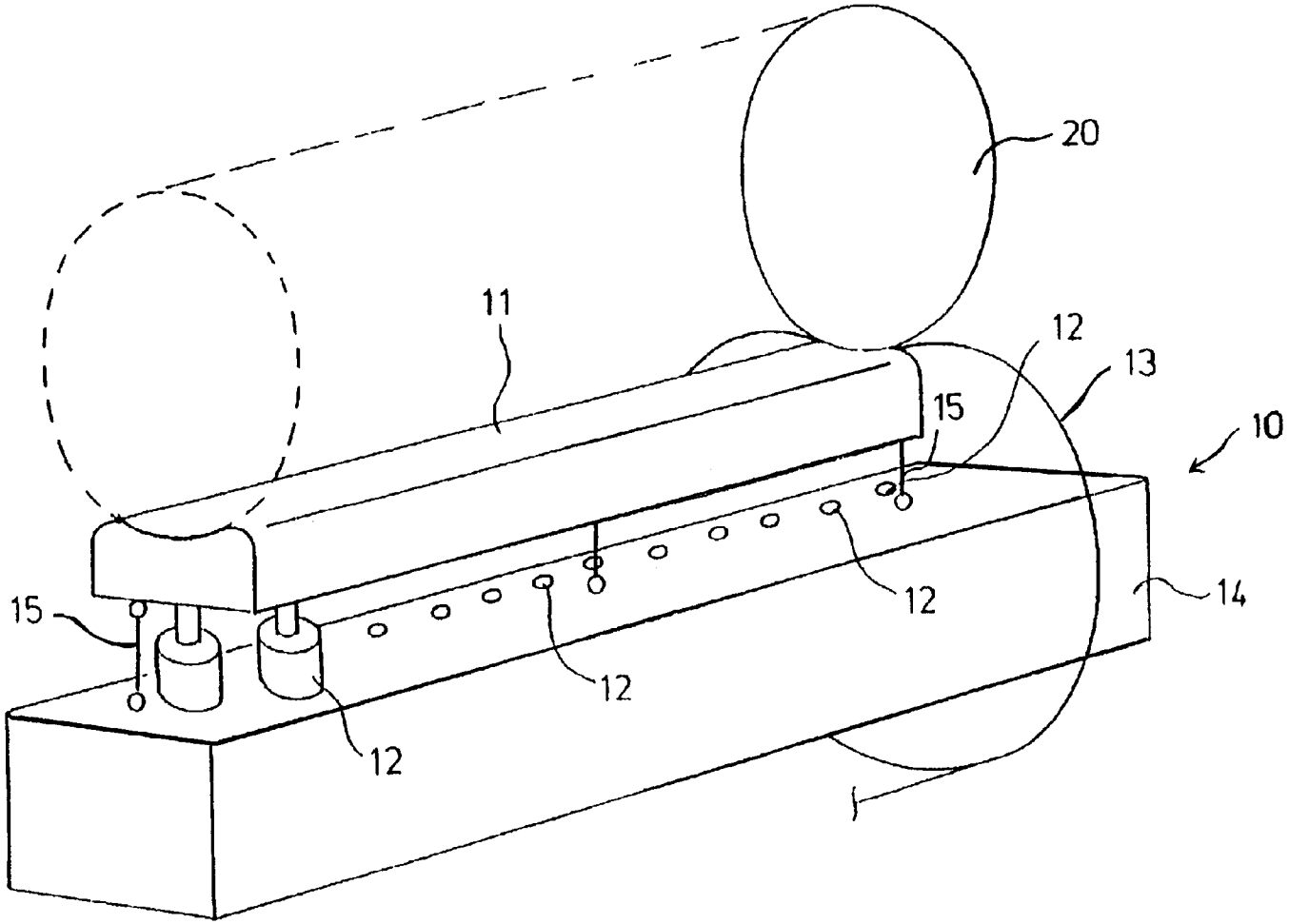

METHOD AND ARRANGEMENT FOR POSITIONING A SHOE OF A SHOE PRESS/ SHOE CALENDAR IN A PAPER MACHINE

The invention relates to a method for positioning a shoe press/shoe calender in a paper machine.

The invention also relates to an arrangement for positioning a shoe of a shoe press/shoe calender in a paper machine, which arrangement comprises a shoe roll or equivalent which includes a shoe and hydraulic cylinders connected thereto for moving the shoe, and a support element to which the hydraulic cylinders and the shoe are attached.

As known in the state of the art, as loading rolls in a shoe press/shoe calender are used loading rolls in which a shoe is placed inside a polyurethane belt. The belt is attached at ends so as to be oilproof and the sock/belt is held tight around the shoe structure. The shoe structure comprises oil ducts and hydraulic cylinders for pressing the shoe against a backing roll/thermoroll. One known arrangement for a so-called belt calender is disclosed in FI patent application 943278, which discloses a device for polishing a paper web or a board web provided with a polishing zone through which the web is passed and which has a given thickness measured in the direction of the web to achieve a longer time of dwell of the web. The device is provided with two polishing surfaces defining the polishing zone on both sides, one of said surfaces being formed by a mantle of a machine-driven roll and the other of said surfaces being formed by a glide felt that runs around; provided with a glide shoe which is wrapped by the glide felt and which has a glide surface complementary to the mantle surface of the roll; provided with means for pressing the roll and the glide shoe against each other.

One problem in the known arrangements is that the position of the shoe is not known, wherefore, for example, when closing, the shoe may be positioned unevenly with the result that an uneven nip force is produced. This may lead, among other things, to breaking of the web.

One problem in calenders, at high speeds in particular, because of an undesirable position of the shoe, is an uneven/undesirable type of draw which is effective in the nip, in which connection uneven compression may break the web.

Moreover, a problem in presses under heavy load is that when the shoe is in an undesirable position, the backing roll and the belt will wear. In addition, problems may arise in the lubrication of the shoe because, when the shoe is out of line, a lubricating oil film is thinner on the edge which comes first into contact with the backing roll.

In a press section, problems may be caused by the fact that, when the nip is closed in an undesirable manner, the press felt may be crumpled.

In high-speed machines with a speed of over 1000 m/min, problems may arise in the controllability of felts and wires, if the shoe pulls felts/wires askew because of its incorrect position.

An object of the invention is to create a solution to the problems described above.

An object of the invention is to create an arrangement in which the position of the shoe is known and the shoe can be guided to a desired position, whereby the problems described above are eliminated.

With a view to achieving the objectives described above as well as those which will come out later, the method according to the invention is mainly characterized in that, in the method, the position of a shoe of a shoe calender/shoe press is measured and that, in the method, the position of the shoe is controlled based on the results of the measurement so as to be as desired in the direction of nip compression.

The arrangement according to the invention is in turn mainly characterized in that the arrangement comprises further at least two measuring devices for measuring the position of the shoe and means for guiding the shoe as desired in the direction of nip compression based on the results obtained by means of the measuring devices. In accordance with the invention, the means for controlling the shoe based on the results obtained by the measuring devices include a processing unit, which can be, for example, a programmable logic or a process or computing station (CPU) of a distributed automation system. The signals computed by the processing unit can be passed to valves which control the movement of cylinders controlling the movement of the shoe, for example, by using standard current or voltage signals of instrumentation or some automation field bus.

In accordance with the invention, the position of the shoe in a shoe calender/shoe press is measured by at least two measuring devices suitable for position measurement, for example, a linear sensor. The position measuring sensors are placed most advantageously close to the edges of the driving and tending sides and in wide machines also in the middle area. In that connection, the position of the shoe is found out, and the nip is caused to close in a desired position since the movements of the hydraulic cylinders can be regulated accurately based on the measurement results obtained.

In accordance with the invention, the shoe of the shoe press/shoe calender is provided with at least two position measuring sensors and the movement of the shoe is regulated based on data provided by the sensors, for example, utilizing a computing algorithm, and the hydraulic cylinders are controlled to operate such that a desired movement and position of the shoe is assured in the direction of nip compression.

When the nip is closed/opened in accordance with the invention, there is no risk of the web breaking, because the position of the shoe is known precisely when the measurement result provided by the position measuring sensors has been received, and the shoe can be positioned in a desired position. In accordance with the invention, also after a web break or downtime, it is possible to control the oil flows of the hydraulic cylinder based on the position data obtained from the position measuring sensors such that the nip is controlled to close in a desired manner, whereby the position of the shoe is caused to be as desired.

In the arrangement according to the invention, the shoe can thus be controlled to close in an optimal manner with respect to the running situation.

In the following, the invention will be described in more detail with reference to the figures in the accompanying drawing, to the details of which the invention is, however, not by any means intended to be narrowly confined.

FIG. 1 schematically shows a shoe roll with which one application of the arrangement according to the invention has been combined.

Figure 2:
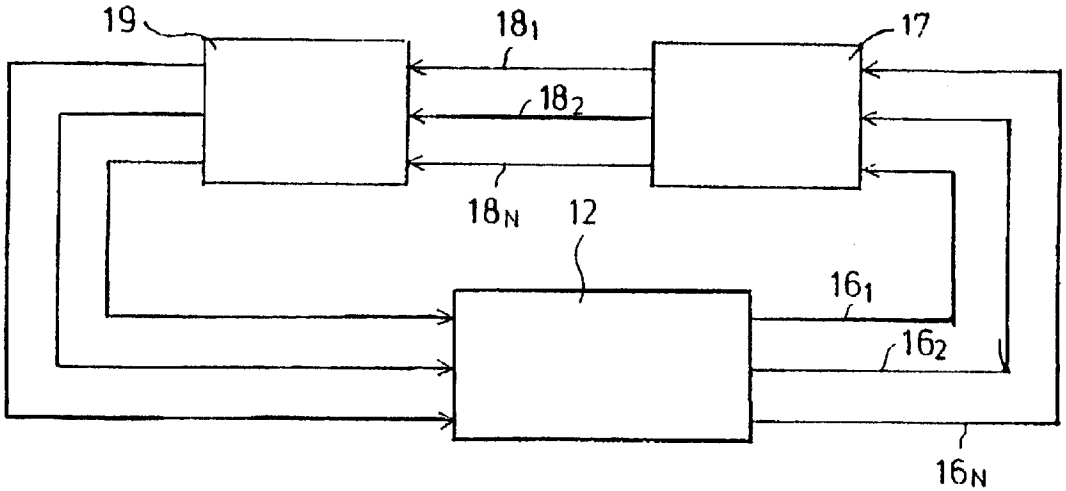

FIG. 2 schematically shows one application of the measurement arrangement according to the invention.

Figure 3:
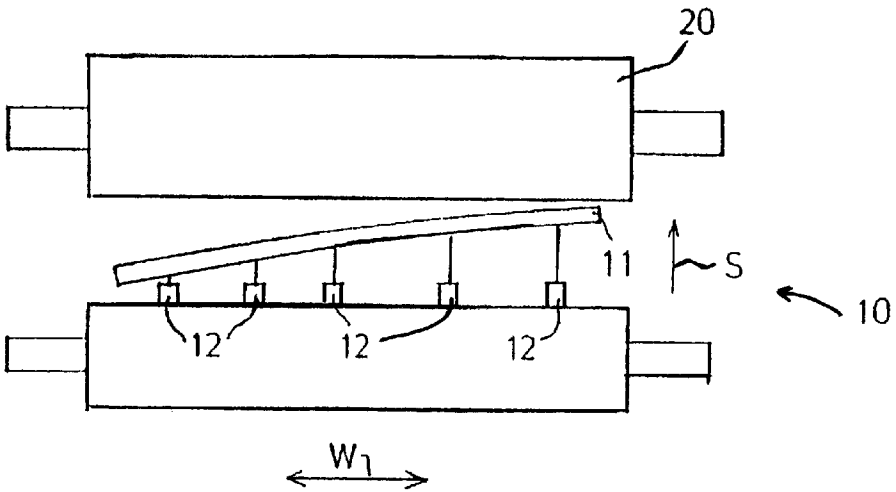

FIG. 3 shows loading of a shoe roll in the direction of nip compression as a schematic application.

As shown in FIGS. 1 and 2, an extended-nip roll, or a shoe roll 10 comprises a shoe 11 located inside a belt 13, which shoe includes hydraulic cylinders 12 for loading the shoe 11. In a loading situation, the belt 13 adjusts itself to the shape of the nip between the shoe roll 10 and a backing roll, to the shape of the shoe 11. The hydraulic cylinders 12 and the shoe 11 are fixed to a frame 14 of the roll 10 and at least two position measuring sensors 15 are arranged in connection with the shoe 11 between the shoe 11 and the frame 14 inside the extended-nip (shoe) roll 10, the position of the shoe 11 between the extended-nip roll 10 and the backing roll 20 in the nip being controlled so as to be of a desired shape based on data provided by the position measuring sensors. Of course, the shoe structure also includes the necessary oil ducts and structures associated therewith, which are not shown in the figures for the sake of clarity. The measuring apparatus or arrangement can be, for example, a linear sensor or an absolute sensor. In order to identify the position of the shoe it is also possible to use some optical arrangement which could be, for example, a directional light source attached to the shoe and moving with the shoe, and a CCD camera matrix fixedly mounted on the frame. In that connection, the location of the shoe would become clear from which of the CCD cells "see" a light signal.

The arrangement shown in FIG. 1 comprises three position measuring sensors 15, the regulation of the position of the shoe 11 being performed based on position measurements $\mathbf{16}_1$, $\mathbf{16}_2$, $\mathbf{16}_N$ (FIG. 2) provided by said sensors by computing signals $\mathbf{18}_1$, $\mathbf{18}_2$, . . . $\mathbf{18}_N$ in a processing unit 17 based on a computing algorithm, which signals are flow instructions for hydraulic valves 19. The movement of the hydraulic cylinders 12 is controlled by means of the signals $\mathbf{18}_1$, $\mathbf{18}_2$, . . . $\mathbf{18}_N$ in order to move the shoe 11 in a desired manner to a desired position in the direction S of nip compression (FIG. 3).

The arrangement in accordance with the invention comprises at least two measuring devices 15 for measuring the position of the shoe 11 and means 12; $\mathbf{16}_1$, $\mathbf{16}_2$, $\mathbf{16}_N$; 17; $\mathbf{18}_1$, $\mathbf{18}_2$, . . . $\mathbf{18}_N$; 19 for controlling the position of the shoe 11 based on the results obtained from the measuring devices so as to be as desired.

In accordance with an embodiment of the invention regarded as advantageous, the position of the shoe roll 10 of a press/calender is measured by means of the position measuring sensors 15, and when the position of the shoe 11 of the shoe roll 10 is found to be incorrect based on the measurement results $\mathbf{16}_1$, $\mathbf{16}_2$, $\mathbf{16}_N$, the means for rectifying the position of the shoe 11 are activated. The regulation of the position of the shoe 11 is carried out based on a computing algorithm by computing in the processing unit 17 the control signals $\mathbf{18}_1$, $\mathbf{18}_2$, . . . $\mathbf{18}_N$ for the hydraulic cylinders 19. The computing algorithm may be, for example, of the form $\Delta Q=f(\Delta X)$, wherein $Q=Q_0-Q_N$, i.e. a change in the flow of oil, and $X=X_T-X_M$, i.e. a desired shoe position—a position measurement. The regulation of position controls the hydraulic valves 19 such that the hydraulic cylinders 12 change the position of the shoe 11 to a desired position in which the shoe 11 can be askew or straight. Normally, the desired position of the shoe 11 is "straight", which means that all the measuring devices 15 get substantially the same value as a result of the measurement of the position. The results must, of course, be interpreted within the limits of the measurement accuracy of the devices.

Example: if there are 2 sensors in use and their measurement accuracy is ±1 mm. Then the measurement result

| | |
|---|---|
| sensor 1: | $x_1$ = 12.31 mm |
| sensor 2: | $x_2$ = 12.14 mm |
| | $x_d = x_1 - x_2$ = 0.17 mm |
| measurement accuracy of sensors: | $e_x$ = 0.1 mm |

can be interpreted as a situation "shoe straight" because the deviation $x_d$ is not significantly greater than the measurement accuracy $e_x$.

However, if it were desired for some reason or other that the position of the shoe be askew instead of straight (for example, on the tending side 3 mm higher than on the driving side), the arrangement according to the invention also allows that.

The invention may also be applied when the nip is closed/opened between the shoe roll 10 and its backing roll thermoroll such that the shoe 11 opens/closes in an optimal fashion, for example, in a desired position and/or at a desired speed. When there is available analog measurement data on the position of the shoe 11 according to the invention, the nip can be controlled so as to close also in a manner other than at a uniform speed. It is possible that at the initial stage of closing, when the nip is still clearly open, it is beneficial to carry out the movement as quickly as possible. When the nip starts to be almost closed, it is advisable to slow down the movement in order that the closing operation should take place more softly. Different paper grades may require that the closing of the nip is softened differently—in the case of thick and durable paper grades the function is not needed at all, whereas in the case of grades which are thin or otherwise poorer in strength, the slowing down of the closing at the final stage is necessary.

As shown in FIG. 3, the shoe 11 of the extended-nip roll 10 is guided to a desired position in the direction of nip compression S so as to be loaded against the backing roll 20. The cross-machine direction is denoted in the figure with the reference sign W.

Above, the invention has been described only with reference to some of its advantageous embodiment examples, to the details of which the invention is, however, not intended by any means to be narrowly confined. Many variations and modifications are feasible within the inventive idea defined in the accompanying claims.

What is claimed is:

1. A method for closing a shoe, positioned within a belt, against a backing roll to form a nip between the backing roll, the belt and the shoe of a shoe press/shoe calender in a paper machine, the nip extending in a cross machine direction, the method comprising the steps of:

measuring the position of the shoe within the belt of the shoe calender/shoe press with respect to a reference position at at least two positions which are spaced from each other in the cross machine direction; and closing the shoe within the belt against the backing roll while controlling the position of the shoe based on the results of the measurement so the nip is of a desired shape.

2. The method of claim 1 wherein the position of the shoe with respect to the reference position is measured by at least two position measuring sensors.

3. The method of claim 2 wherein the shoe has a driving side edge and a tending side edge, and wherein the position of the shoe is measured by a position measuring sensor close to the driving side edge, and a position sensor close to the tending side edge.

4. The method of claim 3 wherein a position sensor is also located in the middle of the machine, and the position of the shoe is measured by the position measuring sensor close to the driving side edge, the position measuring sensor close to the tending side edge, and the position sensor located in the middle of the machine.

5. The method of claim 1 wherein the movement of the shoe is regulated based on the measurement results utilizing a computing algorithm, and hydraulic cylinders of the shoe of the shoe press/shoe calender are controlled to operate such that he shoe moves in a desired manner to a desired position.

6. The method of claim 1 wherein the step of closing the shoe against the backing roll includes quickly closing the nip when in the initial stages of closing, and slowing down the movement when the nip starts to be almost closed.

7. The method of claim 6 wherein the backing roll is a thermoroll.

8. The method of claim 1 wherein the reference position is a fixed position on a frame to which the shoe is mounted.

9. An arrangement for closing a shoe within a belt, against a backing roll to form a nip between the backing roll and the shoe of a shoe press/shoe calender in a paper machine, the nip extending in a cross machine direction, the arrangement comprising:

a shoe roll, having a shoe, a belt within which the shoe is positioned, and hydraulic cylinders connected to the shoe for moving the shoe towards and away from the backing roll;

at least two measuring devices for measuring the position of the shoe, the measuring devices being positioned to determine the position of the shoe with respect to a reference position at two positions on the shoe which are spaced in the cross machine direction; and means for controlling the position of the, shoe during the closing of the shoe against the backing roll to form the nip based on the results obtained by the measuring devices so the nip is of a desired shape.

10. The arrangement of claim 9 wherein the at least two measuring devices comprise position measuring sensors placed close to a tending side edge of the paper machine and a driving side edge of the paper machine.

11. The arrangment of claim 10 further comprising a position measuring sensor placed in the middle of the paper machine between the tending side edge and the driving side edge.

12. The arrangement of claim 9 further comprising means for moving the hydraulic cylinders based on the results of the measurement in order to position the shoe in a desired position.

13. The arrangement of claim 9 further comprising a unit in which a computing algorithm is called out based on the results of the measurement in order to give flow instructions to hydraulic valves which control the hydraulic cylinders such that the hydraulic cylinder move the shoe to a desired position.

14. An apparatus for closing a shoe against a backing roll to form a nip between the backing roll and the shoe in a paper machine, the apparatus comprising:

a backing roll;

a shoe;

a belt within which the shoe is positioned, the shoe being loaded against the backing roll to define a nip by a plurality of hydraulic cylinders;

a frame extending within the belt, the hydraulic cylinders supporting the shoe on the frame;

at least two position measuring sensor arranged in connection with the shoe between the shoe and the frame, the sensors measuring the position of the shoe and producing position measurements, the position measuring sensors being spaced from one another in a cross machine direction; and a processing unit which receives the position measurements from the position measuring sensors, the processing unit generating signals which control the hydraulic cylinders to close the shoe towards the backing roll.

15. The apparatus of claim 14 wherein the at least two position measuring sensors comprise:

a position measuring sensor placed close to a tending side edge of the paper machine;

a position measuring sensor placed close to a driving side edge of the paper machine; and a position measuring sensor placed in the middle of the paper machine.

* * * * *

UNITED STATES PATENT AND TRADEMARK OFFICE

CERTIFICATE OF CORRECTION

PATENT NO. : 6,790,316 B1
DATED : September 14, 2004
INVENTOR(S) : Kari Hasanen et al.

It is certified that error appears in the above-identified patent and that said Letters Patent is hereby corrected as shown below:

Title page,
Item [75], Inventors, "Leppäskoski" should be -- Leppäkoski --; and "Jërvenpää" should be -- Järvenpää --.

Column 4,
Line 66, before "within" insert -- positioned --.

Column 5,
Line 13, delete "," after "the".
Line 33, "cylinder" should be -- cylinders --.

Column 6,
Line 12, "sensor" should be -- sensors --.

Signed and Sealed this

Twentieth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,790,316 B1
APPLICATION NO. : 09/980061
DATED : September 14, 2004
INVENTOR(S) : Kari Hasanen et al.

It is certified that error appears in the above-identified patent and that said Letters Patent is hereby corrected as shown below:

In the title page under Item (73) Assignee, the assignee should be --Metso Paper Karlstad AB, Karlstad (SE)--

Signed and Sealed this

Twenty-seventh Day of November, 2007

JON W. DUDAS
*Director of the United States Patent and Trademark Office*